United States Patent [19]

Hanlon

[11] 4,372,086

[45] Feb. 8, 1983

[54] DISPLAY

[75] Inventor: Albert W. Hanlon, Boylston, Mass.

[73] Assignee: Admore, Inc., St. Shrewsbury, Mass.

[21] Appl. No.: 251,329

[22] Filed: Apr. 6, 1981

[51] Int. Cl.[3] ..... A47B 5/00

[52] U.S. Cl. ..... 52/36; 52/71; 52/668; 46/30; 40/539; 40/605; 229/15

[58] Field of Search ..... 52/36, 71, 668; 40/539, 40/605; 229/15, 27, 42; 160/135, 351; 46/30 R

[56] References Cited

U.S. PATENT DOCUMENTS

| | | | |
|---|---|---|---|
| 1,052,187 | 2/1913 | Stranders | 40/539 |
| 1,194,678 | 8/1916 | Stranders | 40/539 |
| 2,319,924 | 5/1943 | Ferguson | 229/15 |
| 2,840,293 | 6/1958 | Paige | 229/15 |
| 3,173,436 | 3/1965 | Peters | 52/71 |
| 3,766,693 | 10/1973 | Richards | 52/71 |
| 4,043,086 | 8/1977 | Kaulfuss | 52/36 |

FOREIGN PATENT DOCUMENTS

| | | | |
|---|---|---|---|
| 1243060 | 8/1960 | France | 46/30 |
| 436079 | 11/1967 | Switzerland | 46/30 |

*Primary Examiner*—Reinaldo P. Machado
*Attorney, Agent, or Firm*—Blodgett & Blodgett

[57] ABSTRACT

A display construction comprising first and second display panels of light-weight sheet material, each divided into a plurality of vertical planar sections by vertical folds. The top and bottom edges of each panel form a zig-zag pattern that enables the bottom panel to be supported on a flat supporting surface and the second panel supported on the first panel, the lower portions of individual sections of the second panel intersecting the upper portions of individual sections of the first panel.

8 Claims, 6 Drawing Figures

DISPLAY

BACKGROUND OF THE INVENTION

The present invention is directed generally to a display construction and specifically directed to a portable display construction for trade shows or the like.

Displays for trade shows exhibits are custom designed to suit the needs of each individual exhibitor. In most instances, the display is used for a particular trade show and never used again. Although the display is used for a relatively short period of time it must be impressive and stury enough to withstand extensive use during this short period of time. In spite of the fact that the display construction is used for a short period of time, the design and construction of the display involves a good deal of time and expense on the part of the displayer. In addition to the expenses involved in the design and manufacture of the various elements that make up the display construction, the construction must be shipped and then later assembled at the trade show. In most cases, the display must be assembled at the trade show by a carpenter or other skilled labor and a good deal of time is lost by the displayer in supervising the assemblage of the display. This time could be better spent in planning the program for the show. After the show, the display must be disassembled again with the aid of a carpenter or other outside help and then shipped to the displayers plant or disposed of. These and other difficulties experienced with the prior art displays have been obviated by the present invention.

It is, therefore, an outstanding object of the invention to provide a display construction that can be easily assembled and disassembled by the displayer without the need of outside help.

Another object of the invention is the provision of a display construction that is light-weight and portable and can be easily carried by the displayer in a disassembled and folded condition.

A further object of the present invention is the provision of a display construction that is simple and relatively inexpensive, enabling the display construction to be considered an expendable item after one use, but which is durable enough to pass through several diversified uses.

It is another object of the instant invention to provide a display construction that is made up of a plurality of light-weight sheet elements that are assembled to produce a sturdy three-dimensional structure.

A still further object of the instant invention is the provision of a display construction made up of a plurality of light-weight sheet elements that are assembled to produce a three-dimensional structure which includes vertical planar for illustrations and identifying information and a vertical shelf to provide a writing surface or for supporting distribution literature.

With these and other objects in view, as will be apparent to those skilled in the art, the invention resides in the combination of parts set forth in the specification and covered by the claims appended hereto.

SUMMARY OF THE INVENTION

In general, the invention consists of a display construction having first and second display panels of light-weight sheet material. Each display panel has a top edge, a bottom edge, and a plurality of vertical folds that divide the panel into a plurality of planar sections so that the top and bottom edges each extend in a zig-zag pattern that enables the first display panel to be supported on a flat surface along its bottom edge. The upper portions of at least some of the sections of the second panel intersect the upper portions of at least some of the sections of the first panel in a manner that enables the second panel to be removably supported on the first panel.

More specifically, the intersecting sections of the second panel are each provided with a vertical slot in the top edge which is vertically aligned with a vertical slot in the top edge of the intersecting section of the first panel, so that the two panels are interlocked against relative horizontal movement. One or more horizontal shelves is connected to the second panel by means of tabs and rests on the top edge of the first display panel.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
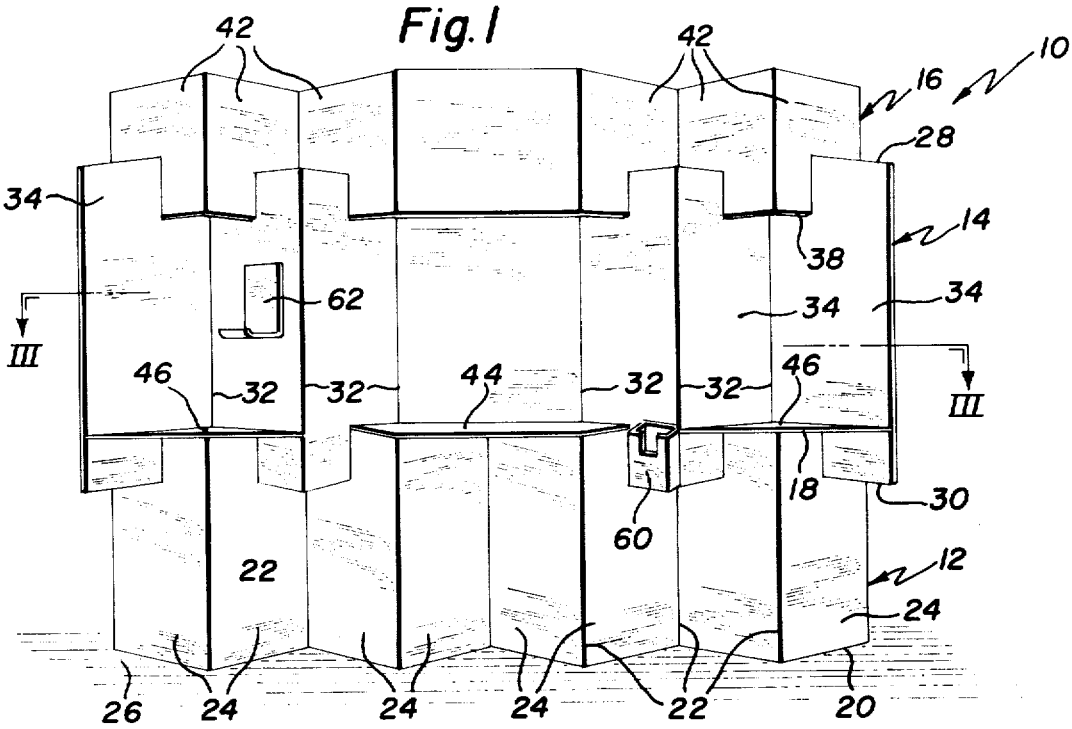
FIG. 1 is a perspective view of a display construction embodying the principals of the present invention.
Figure 2:
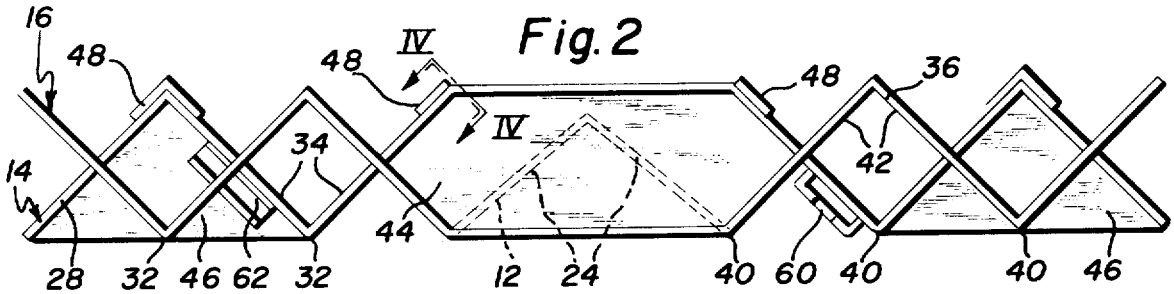
FIG. 2 is a plan view thereof.
Figure 3:
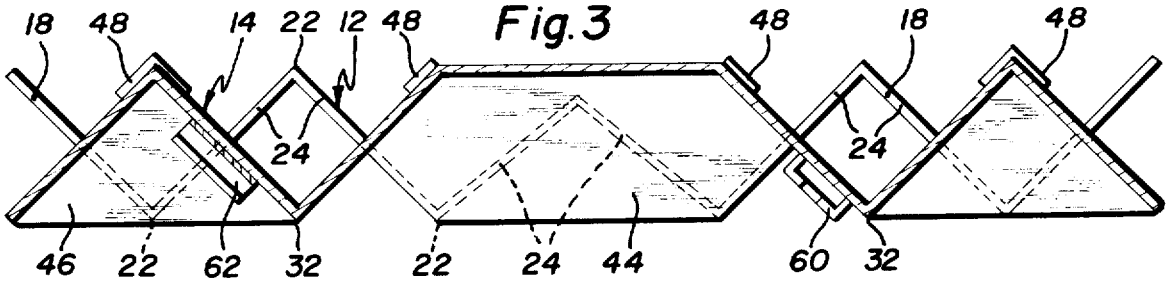
FIG. 3 is a sectional view of the display construction taken along line III—III and looking in the direction of the arrows.

Referring first to FIGS. 1, 2 and 3, which best show the general features of the invention, the display construction, indicated generally by the reference numeral 10, is shown in the fully constructed condition. Display construction 10 consists of a first or bottom vertical display panel generally indicated at 12, a second or central display panel generally indicated at 14, mounted on the first or bottom display panel 12 and a third or top vertical display panel 16 mounted on the second or central display panel 14. Each display panel is made of light-weight sheet material such as cardboard.

The first or bottom display panel 12 has a top edge 18, a bottom edge 20 and vertical folds 22 that divide the panel 12 into a plurality of vertical planar sections 24. The sections 24 lie in different vertical planes so that the top and bottom edges 18 and 20 extend along a zig-zag path that enables the first display panel 12 to be supported on a flat supporting surface 26 along its bottom edge 20.

The second or central display panel 14 has a top edge 28, a bottom edge 30 and a plurality of vertical fold lines 32 that divide the panel into a plurality of vertical planar sections 34. As shown in FIG. 1, the bottom portions of at least some of the sections 34 of the second panel intersect the upper portions of some of the sections 24 of the first panel 12. This is accomplished by means of vertical slots 33 in the top of the panel 12 and vertical slots 35 in the bottom of the panel 14, see also FIG. 6. Slots 33 and 35 are vertically aligned so that the respective intersecting sections 24 and 34, respectively, intersect a vertical distance equal to the combined length of the slots 33 and 35. This enables each pair intersecting sections of the first and second panels to be interlocked against movement in a horizontal direction and provides stability to the display construction 10. The intersecting sections 24 and 34 of the first and second display panels, respectively, extend in different vertical planes and criss-cross when viewed from the top as shown in FIG. 3.

Figure 6:
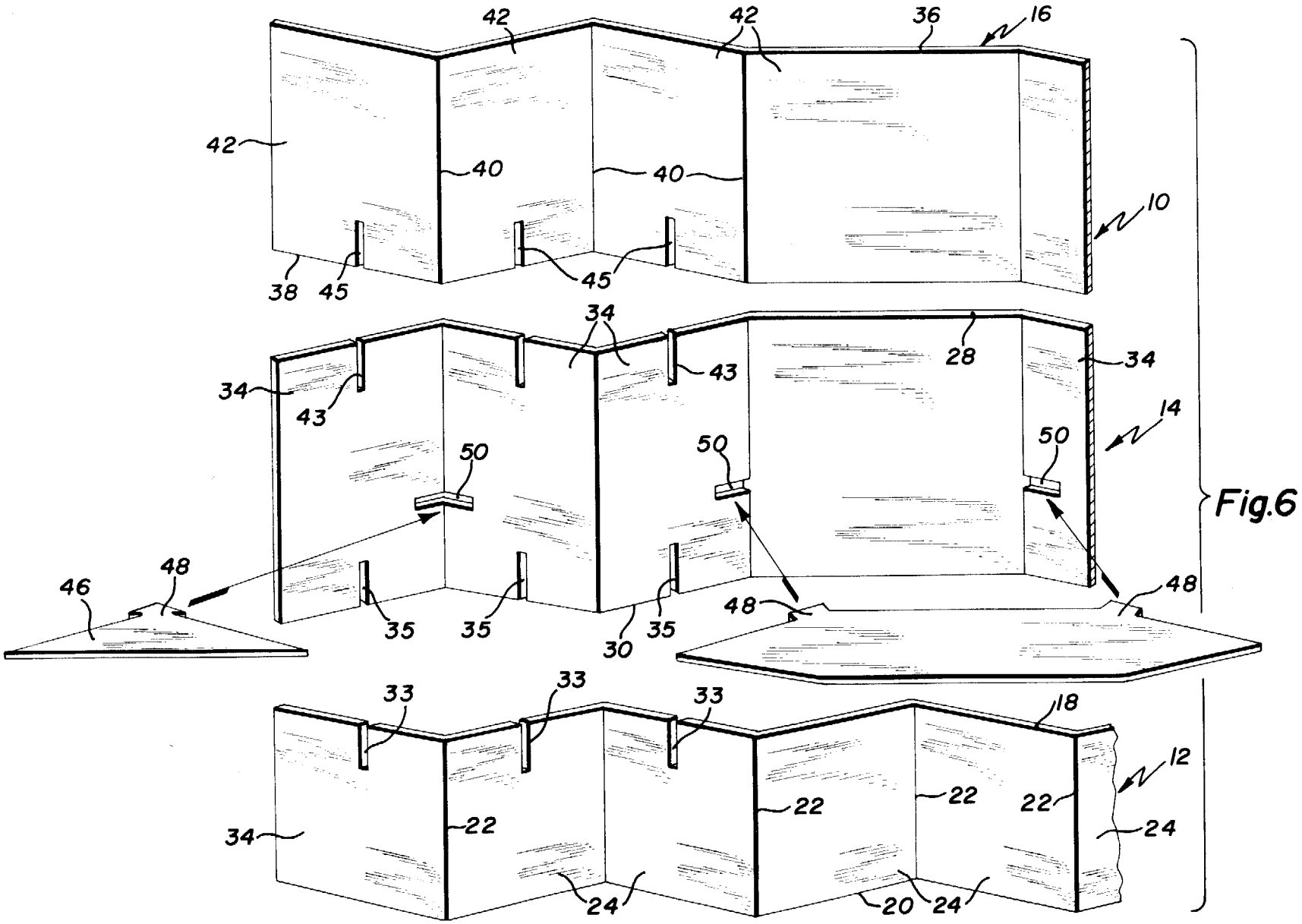
FIG. 6 is an exploded view of the display construction shown in FIG. 1 with portions broken away.

The third or top display panel 16 has a top edge 36, a bottom edge 34 and vertical fold lines 40 to divide the panel 16 into a plurality of vertical planar sections 42. Some of the sections 42 intersect with some of the sections 34 of the second display panel, as shown in FIG. 1. This is accomplished by means of vertical slots 43 in the upper portions of sections 34 and vertical slots 25 in the lower portions of sections 42, as shown in FIG. 6. Slots 43 and 45 of each pair of intersecting sections 34 and 42, respectively, are vertically aligned, so that the bottom portion of the section 42 intersects with the upper portion of sections 34 to a vertical depth equal to the combined lengths of the slots 43 and 45. This enables the third display panel 16 to be securely supported on the second display panel 14 and the intersecting sections 34 and 42 of the second and third display panels 14 and 16, respectively, are interlocked against movement in a horizontal direction, thereby further stabilizing the display construction 10. The intersecting sections 34 and 42 lie in different vertical planes so that they criss-cross, as viewed from the top as shown in FIG. 2. As shown in FIG. 6, the central section of display panels 14 and 16 in the two central sections 24 of the first display panel 12, are not provided with vertical slots and, consequently, do not intersect as shown in FIGS. 1–3. However, the central non-slotted sections of each of the display panels 12, 14, and 16 extend in different vertical planes, as viewed in FIG. 2.

Figure 4:
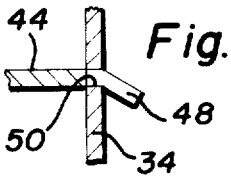
FIG. 4 is a fragmentary vertical sectional view taken along line IV—IV of FIG. 2 and looking in the direction of the arrows and showing a locking tab.

As shown in FIGS. 1–3, the display construction 10 includes a vertical shelf 46 at each end of the structure and a horizontal shelf 44 in the center of the structure. Shelves 44 and 46 are provided with horizontal tabs which extend into elongated horizontal apertures 50 in the second display panel 14, see FIG. 6. Apertures 50 are located just above the top edge 18 of the first display panel 12 when the display construction 10 is assembled as shown in FIG. 1, so that the horizontal shelves 44 and 46 extend just above and are supported by the top edge 18. The shelves 44 and 46 are locked in place by bending the extending portions of tabs 48 at an angle to the horizontal plane of the shelves as shown in FIG. 4.

Figure 5:
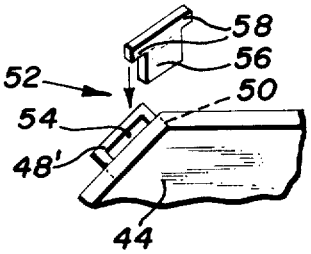
FIG. 5 is a fragmentary view of a locking tab modification.

FIG. 5 shows a modified locking means for the shelves and is generally indicated by the reference numeral 52. Locking means 52 consists of a tab 48' which has a hole 54 in the expending portion thereof and a peg 56 which is inserted into the hole 54 to keep the tab 48' from being pulled out of the aperture 50. Peg 56 has a pair of horizontally extending shoulders 58 which engage the upper surface of the tab 48' and prevent the peg from falling through the hole 54.

The assembly and disassembly of the display construction of the present invention as well as its advantages will now be readily understood in view of the above description. Prior to assembly of the display construction 10, the individual display panels 12, 14, and 16 are folded along their fold lines 22, 32, and 40, respectively, and stacked on top of each other in the folded condition together with the shelves 44 and 46. The stacked display panels and shelves may then be carried as a unit in a carrying case or shipped in a relatively small package to the display location.

The display construction 10 is assembled at the display site by unfolding the display panels 12, 14, and 16 in the manner shown in FIG. 6. The first or bottom display panel 12 is arranged so that its bottom surface 20 rests on supporting surface 26. Next, the second display panel 14 is placed on top of the display panel 12, so that the vertical slots 33 and 35 of the respective sections 24 and 34 are aligned, enabling the sections 34 to intersect with the sections 24, as shown in FIG. 1. The third display panel 16 is then placed on top of the panel 14 so that the vertical slots 43 and 45 of panels 14 and 16, respectively, are vertically aligned to enable the panels 42 and 34 to intersect, as shown in FIG. 1. The shelves 44 and 46 are positioned as shown in FIG. 1, so that tabs 28 enter apertures 50 and enable the shelves to be supported on the upper edge 18 of the first panel 12. Finally, the tabs 48 are bent downwardly, as shown in FIG. 4, to lock the shelves 44 and 46 in place. In the case of the modified locking means 52, shown in FIG. 5, the final assembly step comprises the insertion of pegs 56 into the holes 54 of tabs 48'.

It is apparent from the above description that the display construction of the present invention can be quickly and easily assembled without the need of outside construction workers and the resulting display structure is an attractive and sturdy construction.

The display construction 10 is disassembled just as easily as it is assembled by removing the elements in the reverse order in which they are assembled. The display panels are then folded in the same manner as they were prior to assembly and arranged into a neat stack for insertion into a carrying case or container. The package containing the elements of the display construction is so light that it can be easily carried by a single person and yet when the elements are assembled to form the display construction, shown in FIG. 1, the construction forms a relatively large and sturdy three-dimensional structure. The various planar sections of each panel may contain various display features such as illustrations, instructions, advertising or decorative material. The shelves 44 and 46 provide a firm surface for writing or for supporting distribution literature. If desired, pockets 60 and brackets 62 may be supported on any of the planar sections for holding additional promotional or instructive material.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A display construction comprising:

(a) a first vertical display panel of light-weight sheet material having a top edge, a bottom edge, and a plurality of vertical folds that divide the panel into a plurality of first planar sections so that the said top and bottom edges extend in a zig-zag pattern that enables the panel to be supported on a flat surface along its bottom edge at least some of said planar sections each having a vertical slot that extends downwardly from the top edge, (b) a second vertical panel of light-weight sheet material having a top edge and a bottom edge, said second panel having a plurality of vertical folds that divide the second panel into a plurality of second planar sections so that the top and bottom edges of said second panel each extend in a zig-zag pattern, at least some of the second planar sections each having a vertical slot that extends upwardly from the bottom edge of said second panel, the notches of the first and second panels being vertically aligned for securing the panels in an interlocking relation so that the first and second sections are in different vertical planes, said second panel having an aperture slot which is located above the top edge of the first panel, (c) a horizontal shelf having a tab which extends through the aperture in the second panel and which is supported on the top edge of the first panel, and (d) means for locking the tab against horizontal movement.

2. A display construction as recited in claim 1, wherein said locking means comprises a portion of the tab that extends beyond the aperture and is deformable with respect to the portion of the tab that lies within the aperture.

3. A display construction as recited in claim 1, wherein said locking means comprises:

(a) an extending portion of the tab that extends beyond the aperture, said extending portion having a hole, and (b) a peg extending into said hole.

4. A display construction as recited in claim 3, wherein said peg has a shoulder for engaging the extending portion of said tab.

5. A display construction as recited in claim 1, comprising a third display panel of light-weight sheet material having a top edge, a bottom edge and a plurality of vertical folds that divide the third display panel into a plurality of third planar sections so that the top and bottom edges of said third panel each extend in a zig-zag pattern, the lower portions of at least some of said third sections and the upper portions of at least some of said second sections having complementary aligned vertical slots for securing the second and third sections in an interlocking relationship.

6. A display construction as recited in claim 5, wherein the third display panel is folded in substantially the same manner as the first display panel so that at least some of the third sections are vertically aligned with and like in the same vertical planes as at least some of the first sections.

7. A display construction as recited in claim 6, wherein the second and third panels each have a central section that deviates from the general zig-zag pattern of the panels, said central sections lying in separate spaced parallel vertical planes which are horizontally aligned.

8. A display construction as recited in claim 7, wherein the central section of the second display panel is located at the rearward extremity of the display construction and said shelf is connected to and located in front of the central section of the second display panel and rests on the upper edge of the first display panel.

* * * * *